US005177546A

United States Patent [19]

Tsubo

[11] Patent Number: 5,177,546

[45] Date of Patent: Jan. 5, 1993

[54] IMAGE FORMING APPARATUS

[75] Inventor: Shuzo Tsubo, Fujisawa, Japan

[73] Assignee: Kabushiki Kaisha Toshiba, Kawasaki, Japan

[21] Appl. No.: 721,688

[22] Filed: Jun. 26, 1991

[30] Foreign Application Priority Data

Jun. 27, 1990 [JP] Japan ..... 2-166903

[51] Int. Cl.[5] ..... G03G 21/00

[52] U.S. Cl. ..... 355/314; 270/58; 271/290; 355/313; 355/321; 355/322; 355/323

[58] Field of Search ..... 355/314, 313, 321, 323, 355/319, 308, 309, 204, 322; 271/279, 288, 289, 290, 296, 298; 270/52, 53, 58

[56] References Cited

U.S. PATENT DOCUMENTS 4,273,439 6/1981 Markham et al. ..... 355/314
4,297,025 10/1981 Bach et al. ..... 271/289 X
5,013,027 5/1991 Furukawa ..... 271/290

*Primary Examiner*—A. T. Grimley
*Assistant Examiner*—Matthew S. Smith

[57] ABSTRACT

An image forming apparatus of this invention has a sorter which includes a first document tray on which first documents are placed, a second document tray on which second documents are placed, and two paths which can be switched. When an interrupt copying mode is selected, copies relating to the second documents can be sorted through a path which is different from the path employed for copies relating to the first documents. Even if a great number of copies must be produced and a plurality of copies must be obtained from a plurality of original documents, the wait time can be reduced and the efficiency of the copying operation of the image forming apparatus can be enhanced. Mixture of copies relating to two different original documents can be prevented, and the original documents can surely be separated. Therefore, complexity of copying operations can be relaxed.

6 Claims, 11 Drawing Sheets

IMAGE FORMING APPARATUS

BACKGROUND OF THE INVENTION

1. Field of the Invention

The present invention relates generally to an image forming apparatus, and more particularly to a relatively large-size copying machine including, for example, an auto document feeder for automatically feeding a document to a copying operation start position, and a sorter for grouping or stacking image-reproduce documents.

2. Description of the Related Art

A conventional large-size copying machine designed to enhance the copying operation efficiency is provided with, for example, an auto document feeder (ADF) and a sorter. A user sets originals in the copying machine and inputs data of copying conditions such as the desired number of copies, the reproduction magnification, the grouping/stacking modes, etc. Then, the user turns on a start key. Thus, hard copies which meet the copying conditions can be obtained.

Instead of the ADF, a return auto document feeder (RADF) is also provided in the large-size copying machine. The RADF is capable of automatically reversing an original document, thereby making it possible to reproduce image information on both sides of the document.

An example of the sorter is a coupling type sorter capable of grouping or stacking all reproduced copies by a single operation, even if the number of reproduced copies is large. Normally, a sorter has 5 to 20 storage sections (called "bin") for grouping or stacking. When the number of copies to be reproduced is greater than the number of storage sections, the storage sections are coupled in series (named "coupling type sorter") thereby substantially increasing the number of storage sections.

In the above copying machines with the RADF and coupling type sorter, however, a first copying operation (two or more hard copies are obtained from two or more the RADF and coupling type sorter, however, a first copying operation (two or more hard copies are obtained from two or more originals) cannot be interrupted by a second copying operation (two or more hard copies are obtained from two or more originals). In other words, when the first copying operation is interrupted by the second copying operation, it is necessary to suspend the first copying operation and start the second copying operation and, after the completion of the second copying operation, resume the first copying operation.

Under this situation, the user is unable to fully enjoy the advantages of the expensive large-size copying machine. While the first copying operation, which is to be carried out quickly, is continued, the interruption of the second copying operation is, in fact, disabled. The fact that the interruption of the second copying operation is substantially disabled results in an increase in copying costs.

SUMMARY OF THE INVENTION

An object of the present invention is to provide a copying machine capable of reducing the wait time and enhancing the efficiency of operation.

Another object is to provide a copying machine capable of carrying out an interrupt copying operation wherein a second copying operation in which two or more hard copies are obtained from two different documents can be performed while a first copying operation in which two or more copies are obtained from two or more documents is being carried out.

Still another object of the present invention is to provide a copying machine capable of sorting copies obtained by a new image forming operation to non-used receivers of a sorter, when a current image forming operation including a sorting operation is being carried out and some receivers of the sorter have been used.

According to an aspect of the present invention, there is provided an image forming apparatus, comprising: means for forming an image on a first bearing material or a second bearing material in a predetermined image forming operation corresponding to an image of a document; means for interrupting a first image forming operation of the image forming means and setting the image forming means to a second image forming operation differing from the first image forming operation, while the image forming means is in the first image forming operation; a plurality of receivers for receiving the first and the second image bearing materials having the image formed by the image forming means; and means for sorting the first image bearing materials in at least two receivers, and sorting the second image bearing materials in least two receivers except the receivers receiving the first image bearing materials while image forming means are set in the second image forming operation by the interrupting means.

According to another aspect of the invention there is provided an image forming apparatus comprising: means for forming an image of a document, placed on an image reading region, of an image bearing material; first convey means for conveying a first document towards the image reading region; second convey means for conveying a second document different from the first document towards the image reading region; a plurality of receivers for receiving first and second image bearing materials having the image formed by the image forming means; and means for sorting the first image bearing materials into at least two of the receivers, said sorting means sorting the second document into the receivers other than the receivers in which the first image bearing materials are already stocked, if the second document is fed to the second convey means within a predetermined time period after the image of the first document has been formed on the image bearing material.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE PREFERRED EMBODIMENTS

Embodiments of the present invention will now be described with reference to the accompanying drawings.

Figure 1:
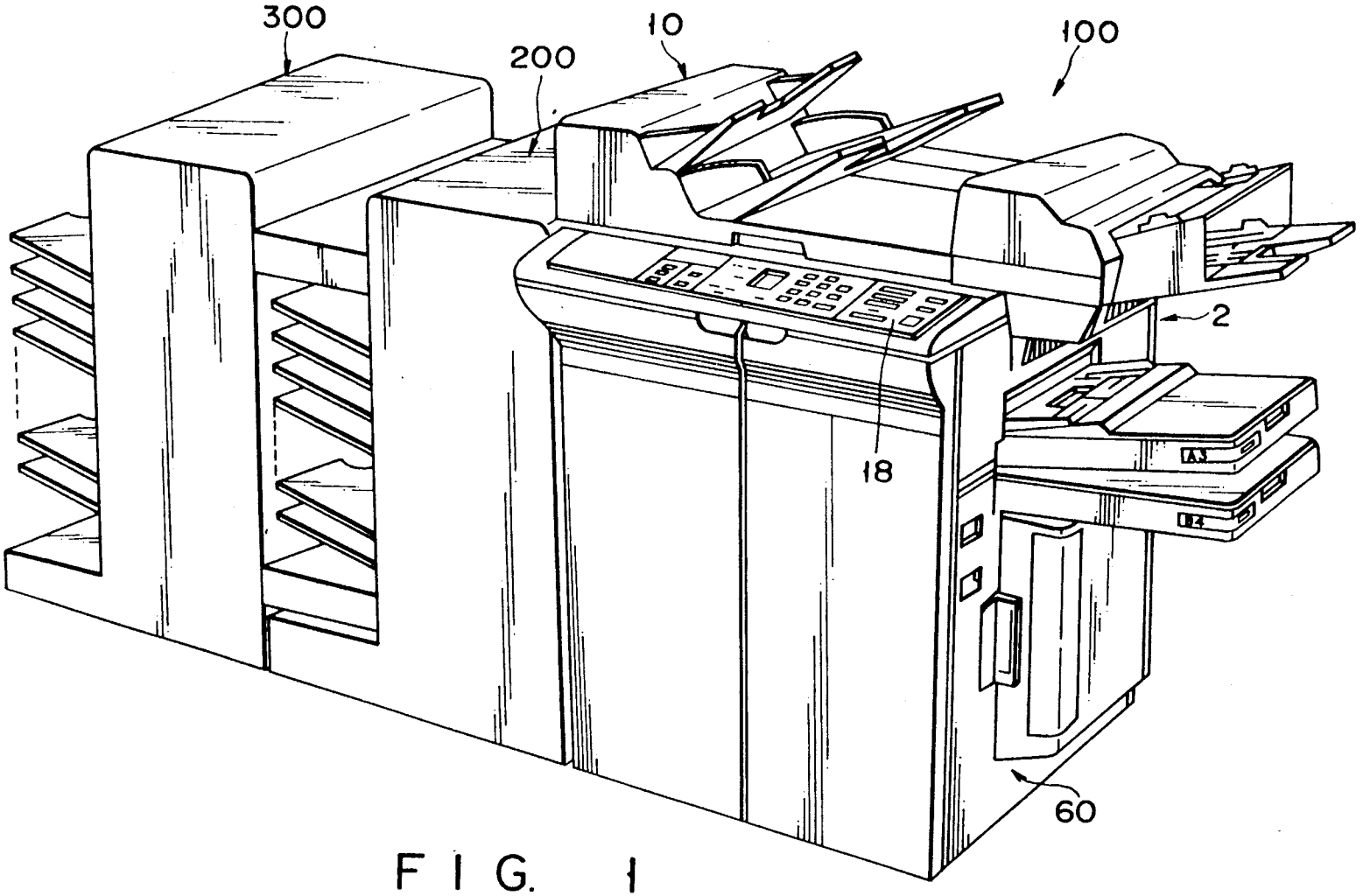
FIG. 1 schematically shows the external appearance of a copying machine employing the sorter of the present invention.

FIG. 1 shows an image forming apparatus 100 according to an embodiment of the present invention. The apparatus 100 includes a main body 2, a return auto document feeder (RADF) 10, a pedestal 60 and at least first and second sorters 200 and 300. The RADF 10 is situated on the body 2 and can be turned away from a document table (described later) provided at the upper part of the body 2. The RADF 10 functions to feed an original D to the body 2. The pedestal 60 can serve as a table for supporting the body 2. The sorters 200 and 300 (the number of sorters is at least two) function to group or stack copies P output from the body 2.

Figure 2:
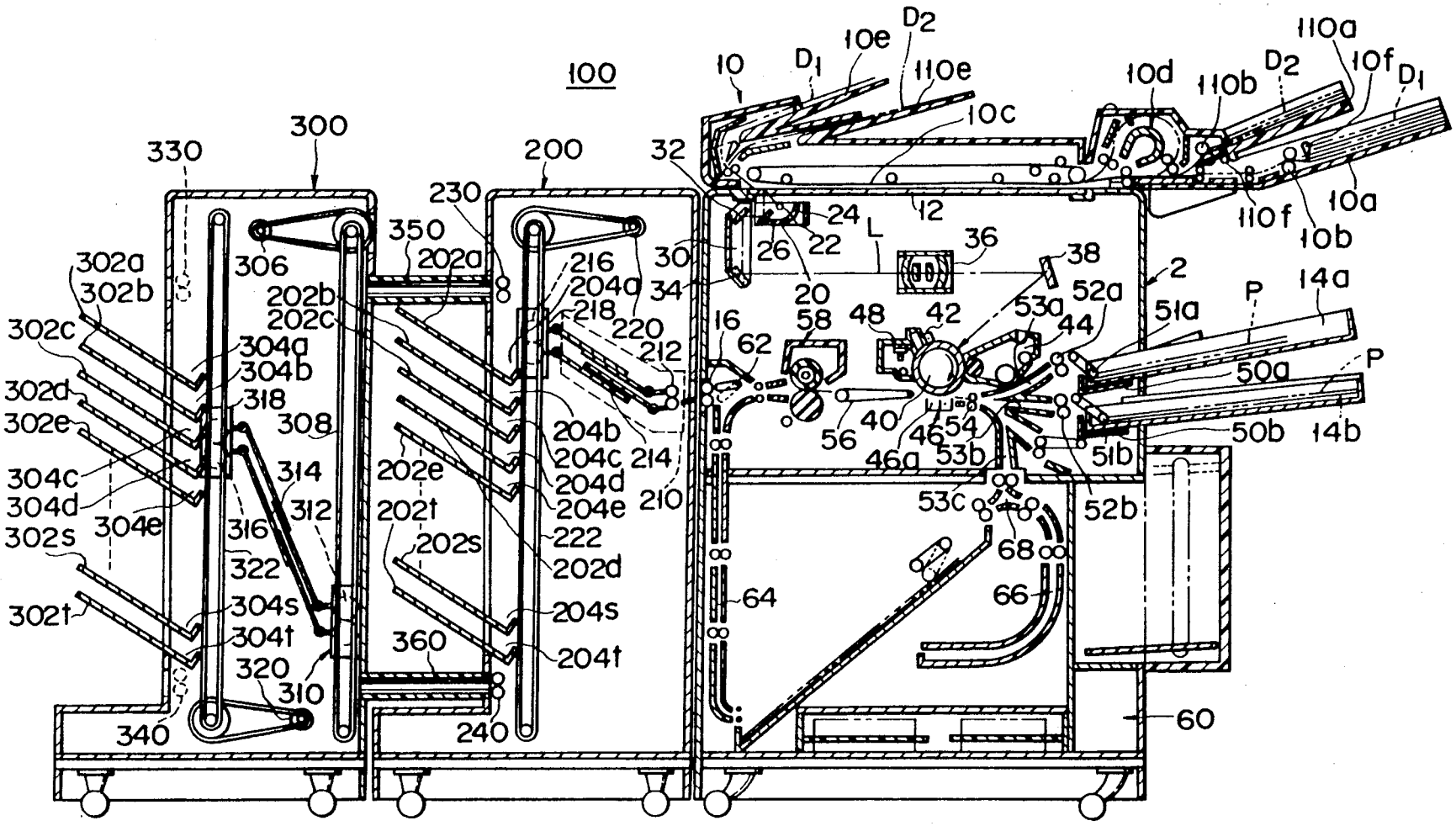
FIG. 2 is a cross-sectional front view of the copying machine shown in FIG. 1.

Referring to FIG. 2, the RADF 10 includes a first document tray 10*a* and a second document tray 110*a*. The first document tray 10*a* receives originals D1 and has a document-detecting switch 10*f* for detecting the setting of the originals D1. The second document tray 110*a* receives originals D2, which are different from the originals D1 and are copied in an interrupt mode, and has a document-detecting switch 110*f* for detecting the setting of the originals D2. The trays 10*a* and 110*a* also have document-feeding rollers 10*b* and 110*b*, respectively, for pulling out the uppermost originals D1 and D2 one by one. The RADF 10 includes a plurality of transporting rollers (accompanied with no reference numerals) and a conveyor belt 10*c*, and a reversing section 10*d*. The transporting rollers and conveyor belt 10*c* convey the document D drawn by the feeding rollers 10*b* and 110*b* to a desired position on the document table 12 of the apparatus body 2. When a double-side copying mode is requested, the reversing section 10*d* causes the conveyor belt 10*c* to rotate reversely, thereby returning the document D which has been conveyed to the desired position on the table 12 and whose information on that side facing the table 12 has been copied. Then, the reversing section 10*d* reverses the document D. The RADF 10 includes a first document stocker 10*e* and a second document stocker 110*e* on the opposite side of the trays 10*a* and 110*a* (i.e. the downstream side of the conveyor belt 10*c* in the forward direction). The first and second document stockers 10*e* and 110*e* stock the documents D, one or both sides of which have been copied and which have been discharged by the forwardly driven belt 10*c*. Document paths and a selecting gate (not described in detail) are provided between the document stockers 10*e* and 110*e* and, thereby, the direction in which the document D travels is changed depending on whether it is fed from the tray 10*a* or the tray 110*a*. (Needless to say the change of the direction of travel is based on the selection of the document to be copied, which is made through a control panel 18 mentioned later.)

As has been described above, the apparatus body 2 includes, at its upper part, table 12 on which the document D is placed by means of the RADF 10, and control panel 18 described later (the panel 18 is not shown in the cross-sectional view of FIG. 2; see FIGS. 1 and 3). On the inside (lower side in FIG. 2) of the table 12, there are provided a lamp 22, a reflector 24 and a primary mirror 26. The lamp 2 illuminates the document D. The reflector 24 converges the light emitted from the lamp 22 to a desired location on the document D. The mirror 26 receives light L reflected from the document D and reflects it to a second carriage 30. A first carriage 20 is provided such that it can be moved reciprocally and in parallel to the table 12 by a pulse motor (not shown) via a plurality of toothed belts or wires are without illustrated. A secondary mirror 32 and a tertiary mirror 34 are arranged at right angles to each other, for guiding the light L reflected from the document D via the first carriage 20 towards a photoconductor (described later). The second carriage 30 is connected to the toothed belt (not shown) for driving the first carriage 20 and is moved along with the first carriage 20 at substantially half the speed the first carriage 20 moves. The first carriage 20 (lamp 22, reflector 24, primary mirror 26) and the second carriage 30 (secondary and tertiary mirrors 32 and 34) extend in a first direction or main scan direction. The first direction is perpendicular to a second direction or sub-scan direction in which the carriages 20 and 30 are moved.

A lens 36 and a holding mirror 38 are situated below the first carriage 20 and along the axis of the light L reflected by the tertiary mirror 34 of the second carriage 30. The lens 36 can be moved by a lens-driving mechanism (not shown), thereby focusing the reflected beam L and magnifying/reducing the image of light L. The holding mirror 38 can be moved by a drive mechanism (not shown) along the optical axis, thereby correcting the fluctuation of the focal length of the lens 36. The holding mirror 38 deflects the light L towards to photoconductor 40 and forms an image at a desired location on the photoconductor 40.

Needless to say, the reflected light L supplied to the photoconductor 40 represents the image or the document D, i.e. characters and graphics.

The photoconductor 40 is situated below the lens 36, that is, near the center of the apparatus body 2. An electrostatic latent image or a charge-distribution pattern is formed on the photoconductor 40 when the light L guided by the mirror 38 is focused on the photoconductor 40. A main charging device 42, a developing device 44, a transferring unit 46 and a cleaning unit 48 are arranged, in this order, around the photoconductor 40. The main charging device 42 applies a predetermined electric charge to the photoconductor 40. The developing device 44 applies toner to the photoconductor 40, in order to convert the latent image to a visible image or a toner image. The transferring unit 46 is designed to transfer the toner image from the photoconductor 40 onto a paper sheet P which has been supplied by means of a material delivering system mentioned later. The transferring unit 46 has an AC charge generating section 46*a* for releasing the paper P from the photoconductor 40 after the toner image has been transferred to the paper P. The cleaning unit 48 electrically discharges the photoconductor 40, thereby restoring the charge-distribution pattern to the initial one and scraping the residual toner from the photo-conductor 40. Since the latent image on the photo-conductor 40 is developed by the developing device 44, converted to the toner image, the electrically guided image on the document D is copied as toner image and formed on the paper sheet P.

At least two slots 50*a* and 50*b* in which paper cassettes 14*a* and 14*b* are inserted are formed at the right part of the apparatus body 2, the upstream side of photoconductor 40 in its rotational direction. From the cassettes 14*a* and 14*b*, plain paper sheets, OHP sheets, etc. are fed towards the photoconductor 40.

A pair of first (upper) feed rollers 51*a*, a pair of second (lower) feed rollers 51*b*, a pair of first transporting rollers 52*a*, a pair of second transporting rollers 52*b*, feeding paths 53*a*, 53*b* and 53*c*, and a pair of timing rollers 54 are provided between the photoconductor 40 and the cassettes 14*a* and 14*b*. The feed rollers 51*a* and 51*b* function to pull out paper sheets P one by one. The transporting rollers 52*a* and 52*b* guide the paper sheets P towards the photoconductor 40 Each of the paths 53*a*, 53*b* and 53*c* is formed by a pair of guide plates. The paths 53*a* and 53*b* guide the paper sheets P from the transporting rollers 52*a* and 52*b* to the photoconductor 40. The path 53*c* guides a copied sheet P towards the photoconductor 40, which copied sheet P has been fed from the photoconductor 40 through the pedestal 60. The timing rollers 54 correct a skew of the sheet P such that the leading edge of the sheet P is aligned with the leading edge of the toner image formed on the photoconductor 40. These timing rollers 54 feed the sheet P to the photoconductor 40 at the same speed as the circumferential speed of the photoconductor 40.

A transporting unit 56, a fixing unit 58, a pair of exit rollers 16 and a sorting gate 62 are arranged within the apparatus body 2 on the left side of the photoconductor 40. The transporting unit 56 feeds a sheet P, which has the toner image transferred thereon electrostatically from the photoconductor 40. The fixing unit 58 melts the toner on the sheet P and fixes the image on the sheet P. The exit rollers 16 feed the copied sheet P from the body 2 to the outside. The sorting gate 62 is located between the exit rollers 16 and the fixing unit 58, for guiding the copied sheet P either towards the exit rollers 16 or into the pedestal 60.

The pedestal 60 is integrally formed under the body 2. The pedestal 60 has a paper returning mechanism for receiving copied sheets P supplied from the body 2 and feeding the sheets P back to the body 2 for effecting double-side copying or multiple copying. Specifically, the paper returning mechanism comprises a paper feeding path 64, a paper reversing guide 66 and a selecting gate 68. The paper feeding path 64 feeds the copied sheet P guided through the sorting gate 62 towards the path 53*c* for double-side copying. The reversing guide 66 turns upside down the sheet P returned through the path 64 for multiple copying, i.e. for forming an image on the reverse side of the sheet P. The selecting gate 68 guides the copied sheet P towards the path 53*c* or towards the reversing guide 66.

A first (front-stage) sorter 200 and a second (rear-stage) sorter 300 for grouping or stacking copied sheets P are integrally provided on the downstream side of the photoconductor 40 (the left side of the apparatus body 2 in FIG. 1; in a copying machine, paper P is supplied from one end of body 2 and discharged to the opposite end of body 2). A jam-detecting switch (not shown) for detecting smooth feeding of sheets P to the sorter 200 is provided on the downstream side of the roller 16.

The sorter 200 includes a sheet guide 210, which is movable vertically, for taking in copied sheets P from the image forming apparatus 100, and a plurality of (20 in this embodiment) bins 202*a*, 202*b* . . . , 202*t* arranged vertically at given intervals. The bins are fixed at one end to the sorter 200 and are made free at the other end. Paper receivers 204*b*, 204*c* . . . , 204*t* for receiving a desired number of copied sheets P are formed between each pair of adjacent bins 202*a* to 202*t*. A receiver 204*a* is formed on the uppermost bin 202*a* since space is defined between bin 202*a* and the frame of the sorter 200.

The sheet guide 210 has a pair of transporting rollers 212 for taking in copied sheets P from the apparatus body 2, and a pair of guide plates having a desired gap therebetween. Each plate consists of two overlapping plate portions. An inlet path 21 is defined by these guide plates. The copied sheets P fed from the rollers 212 are supplied through the inlet path 214 to any one of the receivers 204*a* to 204*t*. The length of the inlet path 214 can be varied by altering the overlapping area of the plate portions of each plate. The plate portions are pivotally fixed at one end to such a position as to surely receive the copied sheets P from the rollers 212. The plate portions at the other end have paired sorter rollers 216 for sorting the sheets P to the receivers 204*a* to 204*t* and are pivotally fixed to a sorting unit 218 for vertically moving the rollers 216 to a desired position. The sorting unit 218 is moved by means of a motor 220 and a belt 222 (driven by motor 220) to a desired position for grouping or stacking the copied sheets P. A first relay roller 230 and a first guide plate (not shown) are provided at the upper limit position of the sorting unit 218, thereby feeding the copied sheets P, where necessary, to the second sorter 300 which is coupled to the first sorter 200. A second relay roller 240 and a second guide plate (not shown) are provided at the lower limit position of the sorting unit 218, thereby feeding sheets P, where necessary, to the second sorter 300. Jam-detecting switches are provided on the downstream side of the first and second relay rollers 230 and 240, for detecting the smooth passage of sheets P from the first sorter 20 to the second sorter 300.

The second sorter 300 is detachable or rotatable and has upper path 350 and a lower path 360 for taking in copied sheets P from the sorter 200. One end portion of the upper path 350 is rotatably provided at the upper part of the sorter 300. By rotating the upper path 350, the path 350 can be connected to the sorter 200. One end of the lower path 360 is rotatably provided at the lower part of the sorter 300. By rotating the lower path 360, the path 360 can be connected to the sorter 200. Needless to say, the sorter 300 may have only one of the upper path 350 and lower path 360, though these two paths are employed to enhance the operation (sorting and stacking) speed. The second sorter 300 has a sheet guide (including transporting rollers 312, inlet path 314 and rollers 316) for taking in copied sheets P from the first sorter 200. The sheet guide 310 can be vertically moved by means of a motor 306 and a belt 308. The second sorter 300 also has, like the first sorter 200, a plurality of (20 in this embodiment) bins 302*a*, 302*b* . . . , 302*t* arranged vertically at given intervals. These bins are fixed at one end to the sorter 300 and made free at the other end. Paper receivers 304*b*, 304*c* . . . , 304*t* for receiving a desired number of copied sheets P are formed between each pair of adjacent bins 302*a* to 302*t*. A receiver 304*a* is formed on the uppermost bin 302*a*.

In addition, like the first sorter 200, the second sorter 300 has a sorting unit 318, a belt 322 driven by a motor 320, and first and second relay rollers 330 and 340 for feeding copied sheets P to rear-stage sorters, for example, where third and/or fourth sorters are connected to the second sorter 300. With additional sorters of the same type as the second sorter 300, a large sorter system with a great number of bins can be formed. If third and fourth sorters 400 and 500 (not shown) are connected to the second sorter 300, an integrated sorter with 60 to 80 bins (each sorter having 20 bins) can be formed. Needless to say, the first and second sorters 200 and 300 may have the same construction. That is, the first sorter 200 may have upper path 250 and lower path 260, like the second sorter 300. As in the first sorter 200, jam-detecting switches (not shown) for detecting the smooth passage of sheets P from the second sorter 300 to the third sorter are provided on the downstream side of the first and second relay rollers 330 and 340. This is applicable to the third and fourth sorters 400 and 500, and a sorter system including an infinite number of sorters can be provided.

Figure 3:
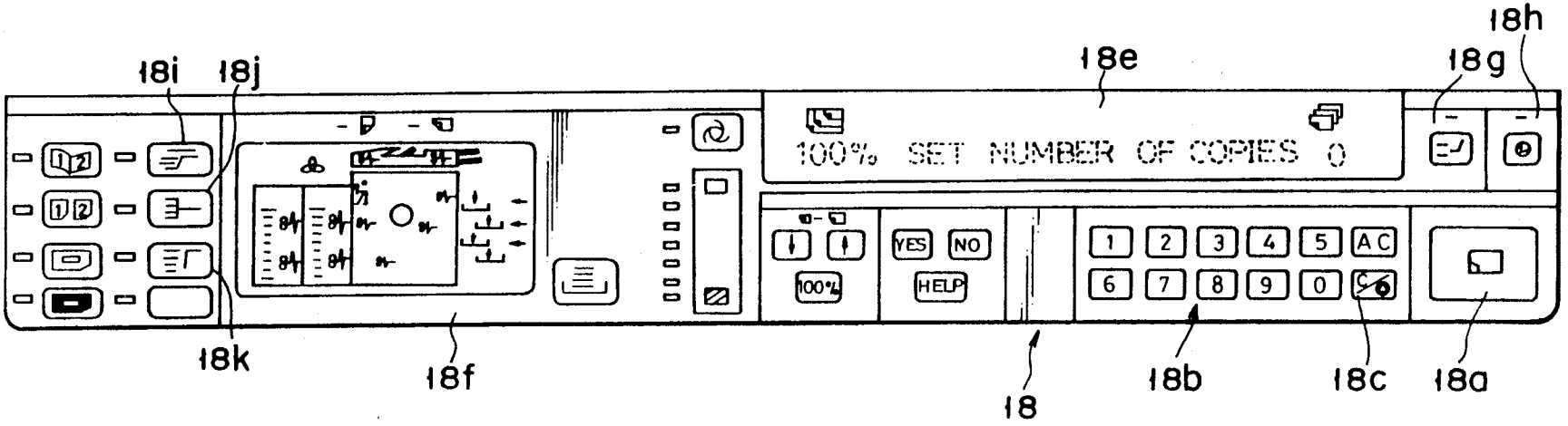
FIG. 3 is a plan view showing a control panel provided on the copying machine shown in FIG. 1.

FIG. 3 shows a control panel 18 provided above the apparatus body 2 and on the cover (not shown) which surrounds the document table 12. The panel 18 has various keys such as a print key 18*a*, number keys 18*b*, a clear key 18*c*, and an all-clear key 18*d*. When depressed, the print key 18*a* generates a print-starting signal. When depressed, the number keys 18*b* ("0"to "9") generate data representing a desired number of copies or other kind of data. When operated, the clear key 18*c* generates a print-stopping signal or cancel any data input. The all-clear key 18*d*, when depressed, generates a signal for stopping all operations and canceling and initializing all copying modes. In other words, conditions for operating the apparatus 2 and print-starting signal are input through the control panel 18. The control panel 18 further includes a liquid-crystal display (LCD) 18*e* and a monitor LED display 18*f*. The LCD 18*e* is designed to display various items of input data (e.g. the desired number of copies, the copy magnification, both set by the operator), and also various messages (e.g. instructions to the operator, the timing of replenishing paper and toner, and error messages). The monitor LED display 18*f* is designed to display what condition the apparatus 2 is in, which cassette has been selected, and where paper-jamming, if any, has occurred.

The control panel 18 further includes an interrupt copy key 18*g* and a pre-heat key 18*h*. The interrupt copy key 18*g*, when depressed, generates a signal for interrupting a first copying operation and carrying out another copying operation. When operated, the pre-heat key 18*h* outputs a signal for maintaining the heated state of the apparatus body 2 and also outputs a control signal for switching the body 2 to the service mode in which a service man performs maintenance.

There are also provided a plurality of sorter-control keys 18*i*, 18*j* and 18*k* for selecting the operation mode of the sorters 200 and 300 (the mode for sorting copied sheets). When the key 18*i* is depressed, the sorters 200 and 300 are set in the non-sort mode. In the non-sort mode, copied sheets P exhausted from the body 2 are fed out, as a batch, to the upper tray (not shown; normally, formed at the upper part of the uppermost tray 202*a*) of the first sorter 200. On the other hand, when the key 18*j* is depressed, the sorters 200 and 300 are set in the sort mode. In the sort mode, copied sheets P exhausted from the body 2 are sorted and stacked sequentially in the receivers 204*a* to 204*t* and 304*a* to 304*t* or the sorters 200 and 300 in accordance with the desired number of copies. When the key 18*k* is turned on, the sorters 200 and 300 are set in the group mode, and copied sheets P exhausted from the body 2 are sequentially stacked in the receivers 204*a* to 204*t* and 304*a* to 304*t* in units of one page of document D.

Figure 4:
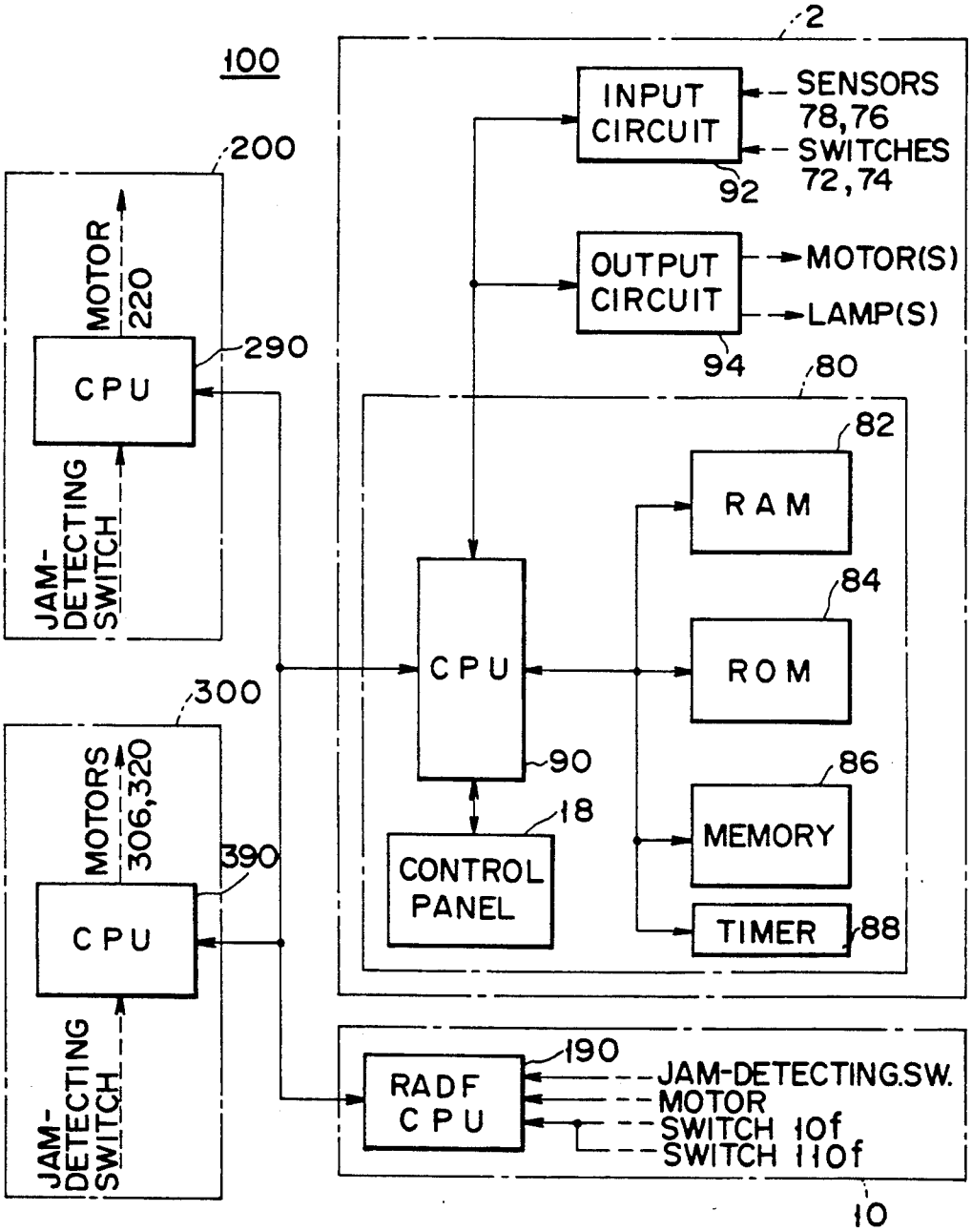
FIG. 4 is a block diagram of an electric control unit built in the copying machine shown in FIG. 1.

FIG. 4 shows a control unit 80 (not shown in FIG. 2) built in the apparatus body 2. The control unit 80 is constituted by, for example, a microcomputer or a CPU 90 for controlling the operation of the body 2. A RAM 82 and a ROM 84 are connected to the CPU 90. The RAM 82 stores temporarily data relating to the number of copies and copying magnification. The ROM 84 stores in advance the data relating to the condition for operating the body 2, for example, an initializing-sequence program for bringing the body 2 to the stand-by state after the apparatus has been switched on. A buffer memory 86 for storing the historical data of the copying operation corresponding to the input condition, e.g. "the number of already copied sheets" as compared to "the number of copies" stored in the RAM 82, or "the position of the paper cassettes" already selected in the copying operation, and a timer 88 for measuring, for example, an input wait time or an interval for holding an interrupt mode. A number of switches and sensors built in the apparatus body 2 are connected via an input circuit 92 to the CPU 90. Paper-empty switches 72 and 74 for detecting the residual sheets P in the respective paper cassettes and a toner-empty sensor 76 for detecting the residual toner T in the developing device. A density sensor (a photoelectric conversion element, e.g. CdS, photo transistor) for detecting the optical density of the image on the document D. The lamp 22 and motors (not shown) are connected to the CPU 90 via an output circuit 94, and the control panel 18 is connected to the CPU 90 via an interface (not shown).

Like in the apparatus body 2, CPUs 190, 290 and 390 are built in the RADF 10, sorter 200 and sorter 300 are connected to the body 2 and integrated as image forming apparatus or copying machine 100, respectively. First and second document-detecting switches 10*f* and 110*f* arranged within the first and second document trays 10*a* and 110*a* are connected through an input circuit (not shown) to the RADF CPU 190. In addition, a motor (not shown) for driving the belt 10*c* for conveying documents placed on the document trays 10*a* and 110*a*, etc. are connected to the RADF CPU 190. Since the RADF 10 is connected to the body 2 via a cable (not shown), the RADF CPU 190 is electrically connected to the CPU 90 in the body 2. The CPUs 290 and 390 are connected through input circuits (not shown) to jam-detecting switches (not shown) and many switches (not shown) situated at desirable positions for detecting the flow of sheets P (current position of sheets P). Further, the CPUs 290 and 390 are connected through output circuits (not shown) to the sorting units 218 and 318 included in the sorters 200 and 300 and to the motors 220, 306 and 320 for driving the sheet guides 210 and 310 in the sorters 200 and 300. Since the sorters 200 and 300 are connected to the body 2 via cables (not shown), like the RADF 10, the CPUs 290 and 390 are electrically connected to the CPU 90 of the body 2.

The copying operation of the apparatus body 2 will now be described.

The documents D1 placed on the document tray 10*a* of the RADF 10 are pulled out one by one from the uppermost one by the document feeding rollers 10*b* associated with the tray 10*a*. The document D1 is conveyed to a desired position on the document table 12 by means of the conveyor belt 10*c*. The document D1 is brought into close contact with the table 12 by the RADF 10 itself.

Copying conditions such as the desired number of copies and the copy magnification are input from the control panel 18, and the print key 18*a* is depressed to generate a print-starting signal. The document D1 is then illuminated by the lamp 22 and reflector 24. The lamp 22 is turned on only while the first carriage 20 is moved forward in the sub-scan direction to scan the document D. Light L reflected from the document D1 is guided to the primary mirror 26. The primary mirror 26 reflects the light L to the secondary mirror 32 of the second carriage 30. The light L guided to the secondary mirror 32 is reflected at an angle of 90°, and led to the tertiary mirror 34. The light L is further reflected by the tertiary mirror 34 by 90°, and is made incident to the lens 36 located at such a position that it can magnify or reduce the image of the document D1 at a desired ratio. The light L is converged through the lens 36 and then deflected by the holding mirror 38. The light from the mirror 38 is supplied to that surface of the photoconductor 40 which has been electrically charged. Specifically, the image (information) on the document D1 (or D2) is recorded on the photoconductor 40 in the form of an optical light/dark pattern, i.e. a specific distribution of electrostatic charge or an electrostatic latent image.

Since the first and second carriages 20 and 30 are moved at a predetermined speed in the sub-scanning direction, as described above, the information on an elongated region extending in the main scan direction on the document D1 is continuously supplied to the photoconductor 40. Accordingly, the complete image on the document D1 is transmitted to the peripheral surface of the photoconductor 40. Unless the magnification set by the operator is 100%, the speed of the pulse motor (not shown) is changed in accordance with the magnification, to move the first and second carriages 20 and 30 (which receive the image on the document D1) in the sub-scan direction.

As the photoconductor 40 is rotated, the latent image formed on the peripheral surface of the photoconductor 40 is moved towards an area to contact with the developing device 44. The developing device 44 supplies toner onto the surface of the photoconductor 40, thus developing the latent image into a visible image.

In the meantime, the cassette 14*a* or 14*b* containing sheets P of optimal size is selected in accordance with the detected size of the document D1 and the set magnification. When the cassette is selected, a drive device (not shown) is actuated to drive the feed rollers 51*a* or 51*b*, whereby the uppermost sheet P in the selected cassette is supplied to the image transfer region located between the photoconductor 40 and the transferring unit 46, from the upstream side in the rotational direction of the photoconductor 40.

More specifically, the sheet P drawn from the cassette 14*a* or 14*b* is fed forward by the transporting rollers 52*a* or 52*b* associated with the corresponding cassettes and guided through the path 53*a* or 53*b* to the image transfer region under the photoconductor 40. In this case, the timing rollers 54 temporarily stop the sheet P, correcting the skew of the sheet P in the sub-scan direction of either the first carriage 20 or second carriage 30, such that the leading edge of the sheet P is aligned with the leading edge of the image on the photoconductor 40. Then, needless to say, the sheet P is fed to the photoconductor 40.

The sheet P, with its leading edge aligned with the leading edge of the toner image (in accordance with the movement of the photoconductor 40), is attracted onto the photoconductor 40 due to the residual electrostatic charge thereon. As the photoconductor 40 rotates, the sheet P passes through the image transfer region. At this time, the transfer unit 46 applies an electric charge to the photoconductor 40 and sheet P, which electric charge is of the same polarity as the charge already applied to the photoconductor 40 for forming the latent image. As a result, the toner is attracted (transferred) from the photoconductor 40 onto the sheet P. The sheet P on which the toner has been transferred is released from attraction to the photoconductor 40 by AC voltage applied from the AC charging section 46*a* of the transferring unit 46. The sheet P bearing the toner is fed out to the transporting unit 56. The sheet P is guided to the fixing unit 58 via the transporting unit 56. Since the fixing unit 58 has been heated to a temperature high enough to melt the heat-soluble toner, the toner on the sheet P melts and partly permeates into the sheet P, and the toner adheres to the sheet P.

The photoconductor 40 from which the sheet P and the toner image have been separated is further rotated and cleaned by the cleaning unit 48. The residual toner is removed from the photoconductor 40 by the cleaning unit 48, and a discharge lamp (not shown) is turned on to restore the charge distribution pattern on the surface of the photoconductor 40 to its initial one. Thus, the photoconductor 40 is made ready for the next copying operation.

When the double-side copying mode is set in the apparatus body 2, the copied sheet P is guided from the fixing unit 58 to the pedestal 60 via the sorting gate 62. The sheet P passe through the path 64 and is reversed. The reversed sheet P is guided once again to the timing rollers 54 via the path 53*c* and is subjected to the next copying process. Simultaneously, the document D1 is drawn back to the reversing section 10*d* by the reverse rotation of the conveyor belt 10*c*. In the reversing section 10*d*, the document D1 is turned upside down. The reversed document D1 is conveyed to a desired position on the document table 12 once again by the forward rotation of the conveyor belt 10*c*. At this time, as has already been described, the first and second carriages 20 and 30 are moved in the sub-scan direction and the lamp 22 is turned on. Further, the movement of the carriages 20 and 30 is synchronized with the sheet P (one-side copying was effected) which has been stopped by the timing rollers 54, thus carrying out the double-side copying operation.

On the other hand, when the multiple copying mode is set in the apparatus body 2, the copied sheet P on which toner was fixed is guided from the fixing unit 58 to the pedestal 60 via the sorting gate 62. By the operation of the selecting gate 68, the sheet P is conveyed towards the reversing guide 66. Thereafter, the sheet P (one-side copying was effected) is returned through the selecting gate 68 (i.e. copying is effected once again on that side of the sheet P on which copying was already effected). The sheet P is guided to the timing rollers 54 via the path 53*c*. Subsequently, like the double-side copying operation, the next copying operation is carried out by moving the carriages 20 and 30 and turning on the lamp 22. In this case, needless to say, the document D1 fed to the document table 12 by the RADF 10 is either the document d1 subjected to the first copying process (the image on one side of which was already copied) or newly fed document D1.

In the above-described copying operation (double-side copying or multiple copying), the first document D1 (D1', D1''. . . ) placed on the first document tray 10*a* of the RADF 10 is fed to a desired position on the document table 12 one by one for every copying operation. In addition, sheets P are successively fed or returned in accordance with the preset copying mode.

A process of successively stocking copied sheets P will now be described in detail.

Figure 5:
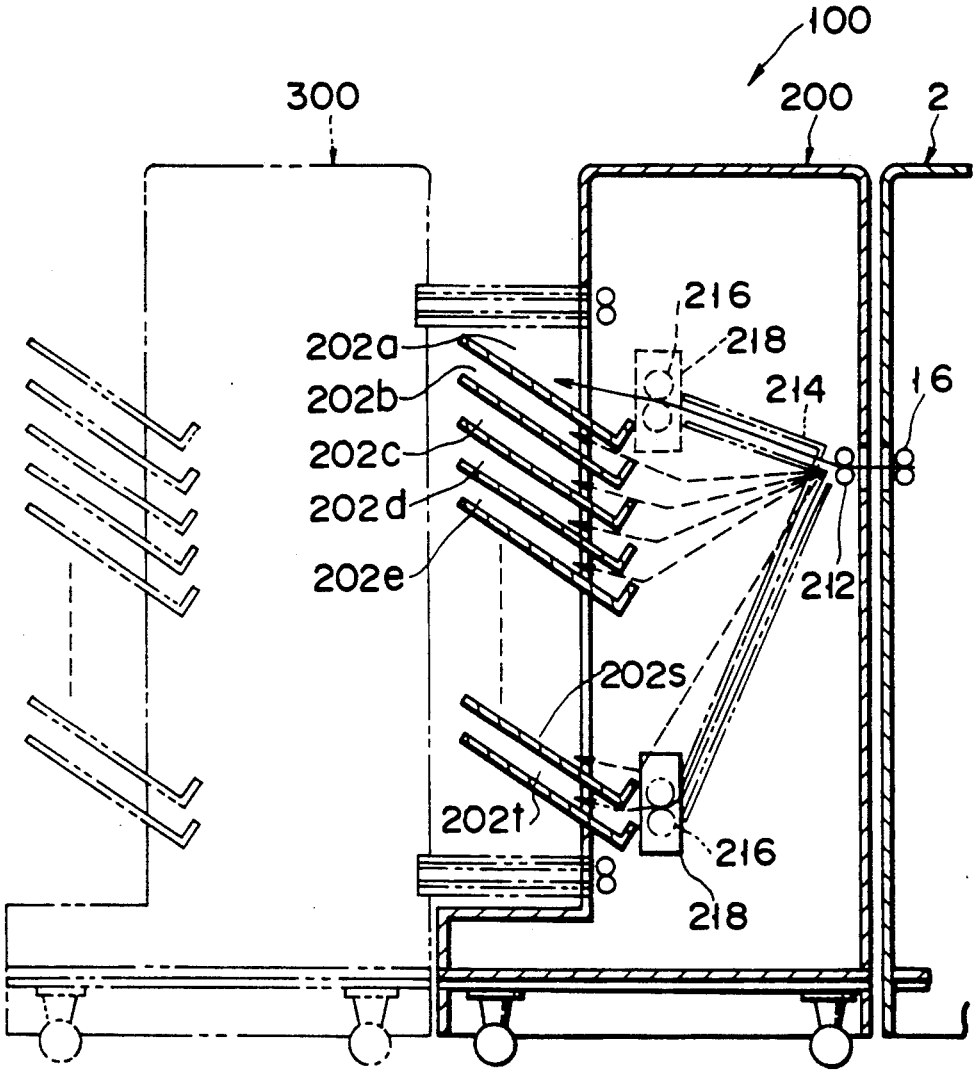
FIG. 5 illustrates an operation mode of the copying machine shown in FIG. 5.

Referring to FIG. 5, paper sheets P on which images of documents D have been copied are successively discharged to the bins (receivers) of the sorters 200 and 300 via the exit rollers 16 of the apparatus body 2. As has been described above, the sorter 200 has the receivers 204*a* to 204*t* formed by the 20 bins 20*a* to 20*t* of the sorter 200. At the time the jam-detecting switches (not shown) have detected the passage of the copied sheet P to the sorter 200, the sorting unit 218 is moved to a desired position and the sheet P is stocked in the receiver 204*a*. Similarly, each time the copied sheet P is fed, the sorting unit 218 is successively moved to a desired position and the sheet P is successively stocked in the receiver 204*b* and the rest. In other words, sheets P on which the image of the document D have been copied in accordance with the desired number of copies are successively stocked in the first receiver 204*a*, second receiver 204*b*. . . , 20*th* receiver 204*t*. In this embodiment, the number of bins of the sorter 200 is 20. If the desired number of copies is 21 or more, the copied sheets P which are not stocked in the 20 receivers of the first sorter 200 are stocked in the second sorter 300.

Figure 6:
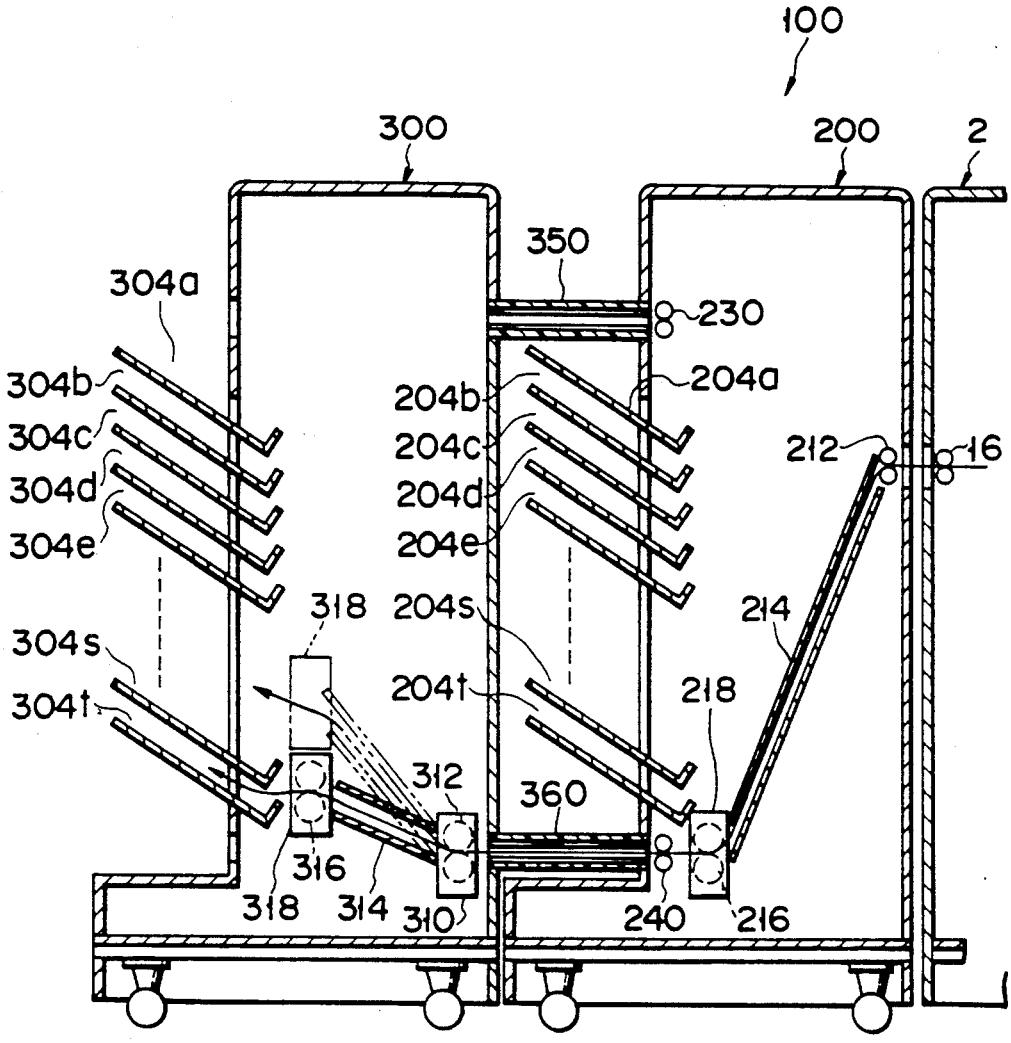
FIG. 6 illustrates another operation mode of the copying machine of FIG. 5.
Figure 7A:
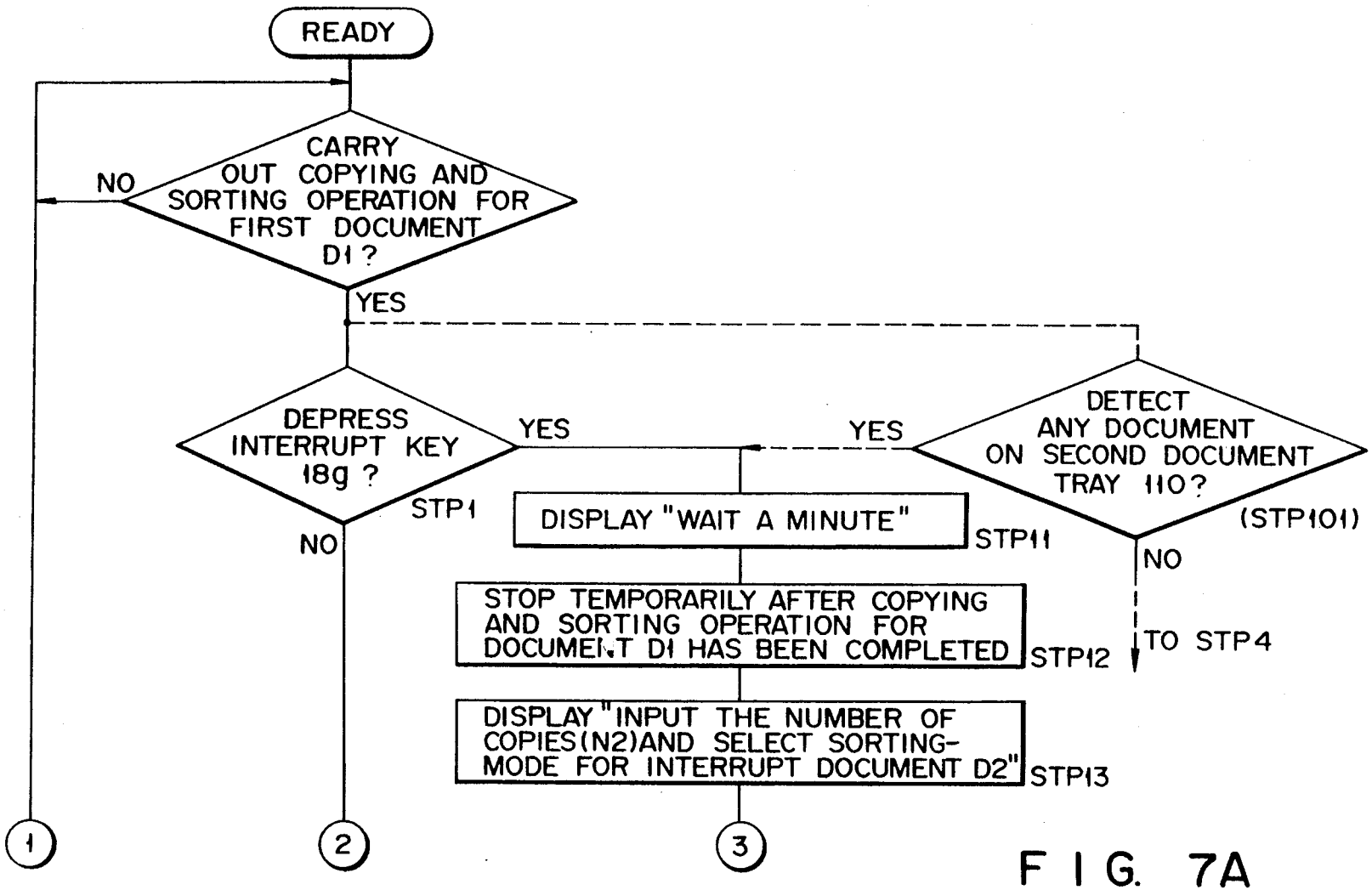
FIGS. 7A to 7D are flowcharts illustrating an operation mode of the copying machine, which characterizes the present invention.
Figure 7B:
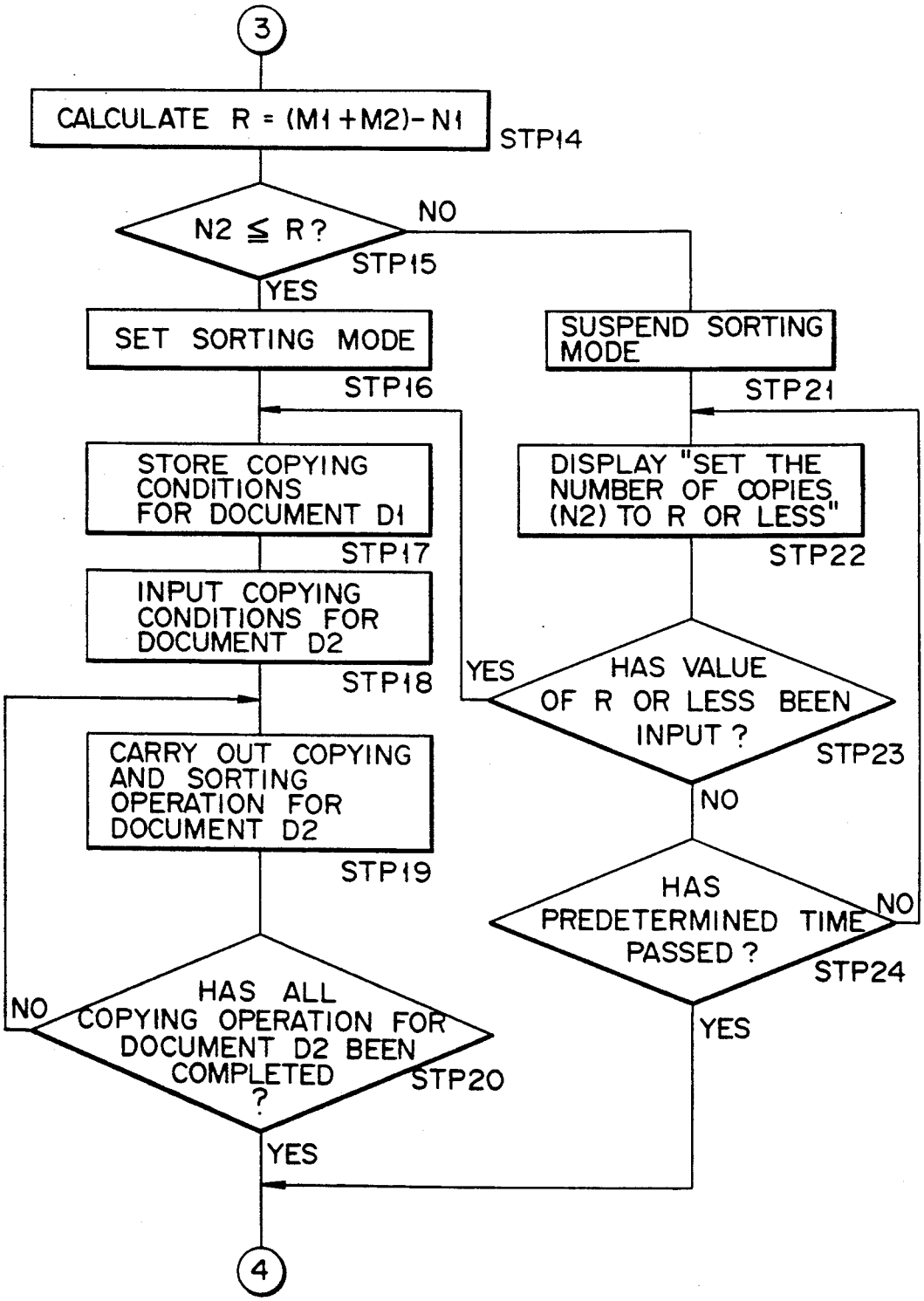
Figure 7C:
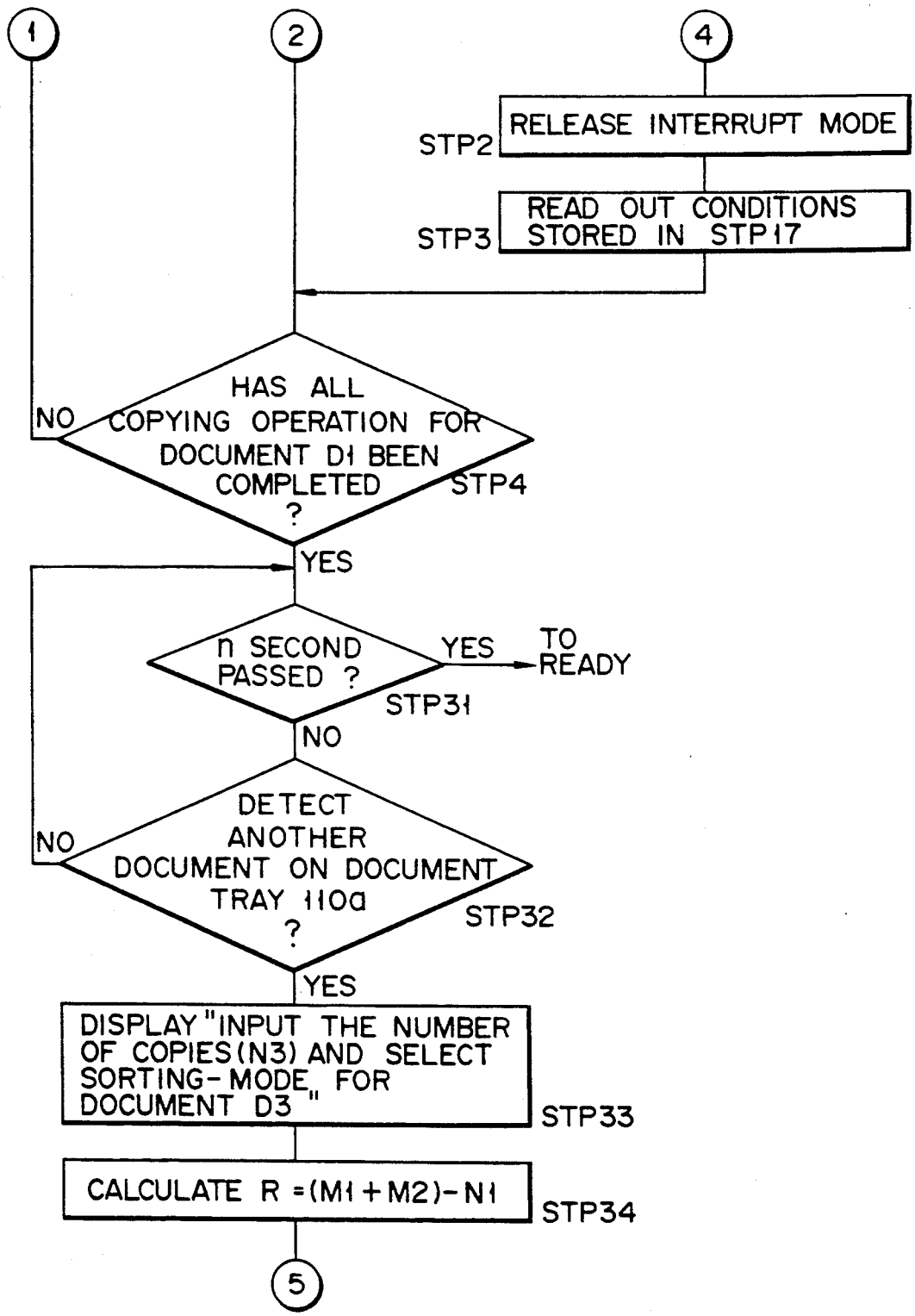
Figure 7D:
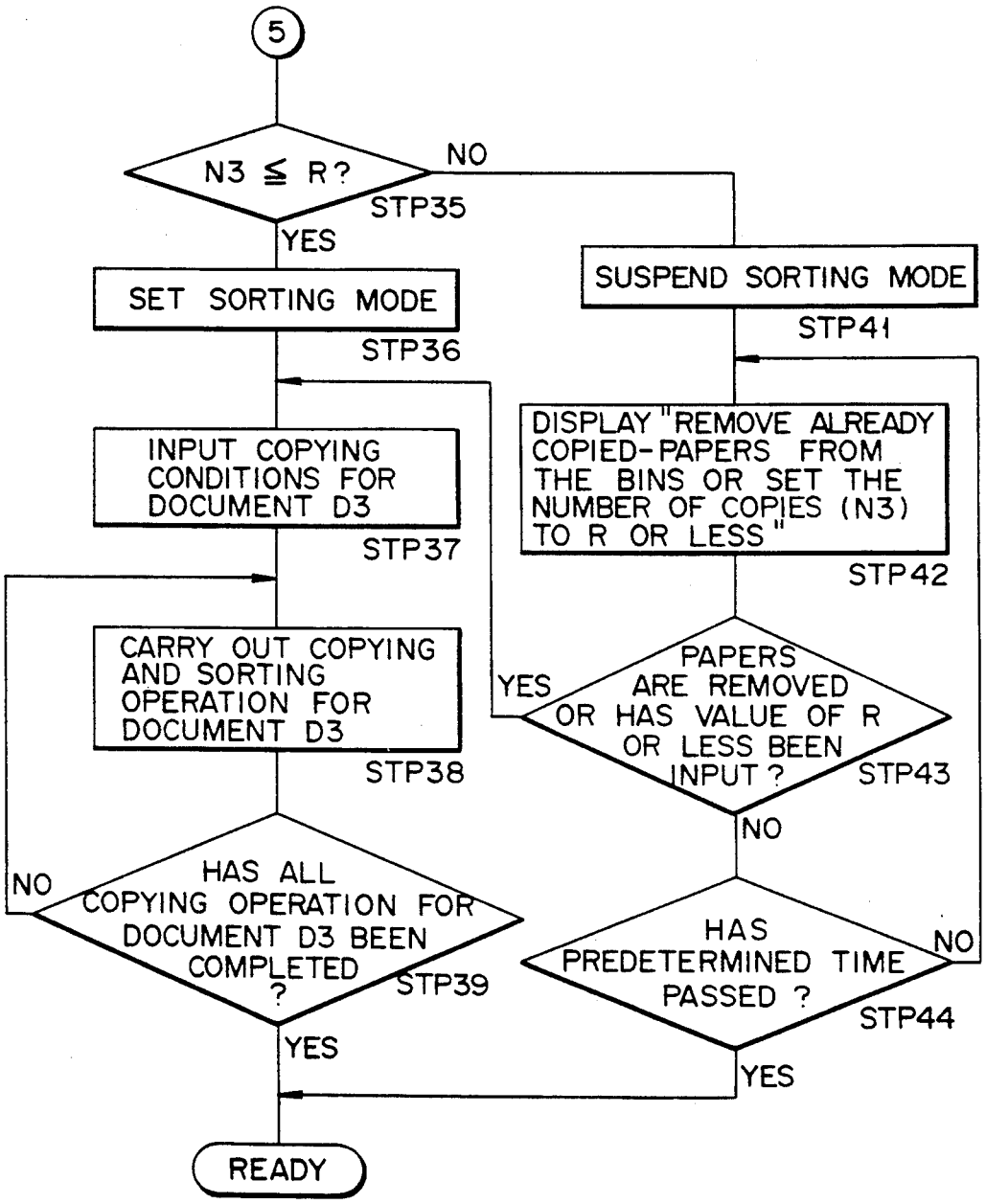

FIG. 6 illustrates the sorting operation, for example, when the desired number of copies is 25. Similarly with the example shown in FIG. 5, the first copied sheet P is fed to the sorter 200 via the exit rollers 16 in the apparatus body 2. Once the jam-detecting switch (not shown) has detected the smooth passage of the copied sheet P to the first sorter 200, the sorting unit 218 is moved to a desired position and the sheet P is stocked in the receiver 204*a*. Similarly, the second to twentieth copied sheets P'. . . , P'' are successively fed to the second to twentieth receivers 204*b* to 204*t*. Thereafter, when the jam-detecting switch has detected the passage of the 21st copied sheet P to the first sorter 200, the sorting unit 218 is driven by the above-described belt 222 and motor 220 to the lower limit position where the second relay rollers 240 and second guide plate (not shown) are situated. (The roller 240 and second guide plate are so positioned as to feed the copied sheet P to the lower path 360 of the second sorter 300 coupled to the second sorter 200.) Simultaneously, the sheet guide 310 of the second sorter 300 is moved to the position corresponding to the lower path 360. In addition, the sorting unit 318 of the sorter 300 is moved to such a position as to be able to feed the sheet P to a desired receiver (the receiver 304*t* in this embodiment). In this embodiment, the last used receiver in the first sorter 200 is the lowermost receiver 204*t*. In order to reduce to a minimum the time needed for stocking the 21st and subsequent sheets P and to decrease the sorting time (copying time), the sorting unit 318 of the sorter 300 is moved from the lowermost receiver 304*t* to the uppermost receiver 304*a*, reversely 'to the first sorter 200. Specifically, the 21st sheet P fed to the second sorter 300 is stocked in the lowermost receiver 304*t* of the sorter 300. Subsequently, 22nd, 23rd . . . , 25th copied sheets P are successively stocked in the receivers 304*s*, 304*r* . . . , 304*p*. Accordingly, by coupling at least one sorter 300 to the first sorter 200 initially coupled to the image forming apparatus 100, all copied sheets P can be sorted even if the desired number of copied sheets P is greater than the number of receivers (10 in this embodiment) of the first sorter 200. Then, the next document D1' is conveyed from the document tray 10*a* and the desired number of copies are repeatedly made. The copied sheets P are successively stocked in the sorters 200 and 300. The document D, after copying is finished, is exhausted to the first document stocker 10*e*.

Next, a copying operation will be described, wherein a second copying operation ("interrupt copying operation") must be carried out while a first copying operation is currently performed. In this case, the second copying operation must be urgently performed, and two or more copies must be obtained from two or more original documents in the second copying operation. A description will also be given about a copying operation for copying a new document in the state in which copied sheets P are already present in some of the receivers 204*a* to 304*t* of the sorters 200 and 300, i.e. in the state in which sheet P have not yet been removed from the sorters 200 and 300.

Referring to FIGS. 7A to 7D, the interrupt key 18*g* (see FIG. 3) of the control panel 18 is depressed during the copying and sorting operation for the first document D1 (STP 1). The copying machine of this invention has the second document tray 110*a* for receiving the second document D2; therefore, the copying mode may be automatically changed at the time the second document D2 has been placed on the second document tray 110*a* (STP 101). (However, when the apparatus body 2 is in the ready state and the two kinds of documents D1 and D2 are placed substantially simultaneously on the first and second trays 10*a* and 110*a*, the document D1 on the first tray 10*a* is first copied.)

At this time point, the LCD 18*e* on the control panel 18 displays, for example, message "Wait a minute" (STP 11; an example of the message displayed on LCD 18*e* is omitted). For example, if the document D1 has images on both sides and the double-side copying mode is selected and the image on one of both sides has already been copied (or the image on one of both sides is currently being copied), the copying mode is changed after the double-side copying operation and sorting operation for the currently loaded document D1 have been completed. In other words, even if the interrupt key 18*e* has been depressed, the copying mode is not changed until the current copying operation is completed. (STP 12).

After the operation of the apparatus body 2 is temporarily stopped, the LCD 18*e* displays, for example, message "Input the desired number of copies and select the operation mode" (STP 13; an example of the message displayed on LCD 18*e* is omitted). In response to the message, the desired number of copies is input by means of numeral keys 18*b* on the control panel 18 simultaneously, upon the depression of any one of the sort mode keys 18*i*, 18*j* and 18*k*, it is determined if the interrupt copying operation (set in STP 1). Then the CPU 90 determines whether or not the interrupt copying operation prevents the currently performed first copying operation.

Hereinafter, the operation of the present apparatus will now be described, supposing that the key 18*j* is turned on to select the sort mode. Suppose that N1 is the desired number of copies of document D1, which is now being copied (i.e. the number of used receivers in the sorters); N2 is the desired number of copies of the second document D2 which is to be copied by the interrupt mode; M1 is the number of receivers in the first sorter 200; M2 is the number of receivers in the second sorter 300; (M1+M2) is the limit number of copies to be stocked; and R is the number of receivers (i.e. non-used receivers) which can be used for the copying operation of the second document D2. In this case, the following equation is calculated (STP 14):

ti $R=(M1+M2)-N1$

Subsequently, it is determined whether the following relation is satisfied (STP 15):

$$R \geqq N2.$$

If the number of copies (N2) is less than the number of receivers (R), the interrupt copying mode is set (STP 16). At this time, the number of already copied documents D1 and the number of already obtained copies and the presently set copying conditions (e.g. magnification, selected sheet size) are stored in the buffer memory 86 (STP 17). The second document D2 is placed on the second document tray 110*a* and the desired number of copies and copying conditions (e.g. magnification) are set (STP 18). When the print key 18*a* is turned on, the copying and sorting operations are started. Simultaneously, the sorting unit 218 of the first sorter 200 is moved to the upper limit position which corresponds to the upper path 350 of the second sorter 300. Further, the sheet guide 310 of the sorter 300 is moved by the belt 308 and motor 306 to the position corresponding to the upper path 350, and the sorting unit 318 is moved to a desired position (at which sheet P is fed to the desired receiver). Thereafter, the document D2 is fed onto the document table 12, and a desired number of copies of the document D2 are obtained. The obtained copies are successively fed to the sorter 300 (STP 19; see FIG. 8). It is checked whether the interrupt copying operation for the document D2 has been completed (STP 20).

On the other hand, if the number of copies (N2) obtained by the interrupt copying operation is greater than the number of non-used receivers (R), the interrupt copy operation is prevented (even if the print key 18*a* is depressed, the copying operation is not executed) (STP 21). When the number of copies (N2) of the second document D2 is greater than the number of available receivers (R) and the interrupt operation is prohibited, the LCD 18*e* displays, for example, message "Reduce the number of copies to a value not higher than R" (STP 22; an example of the message displayed on LCD 18 is omitted). This message is based on the above-mentioned "R=(M1+M2)=N1, R≧N2", and it intends to give an alarm to the user regarding the number of available receivers which can be used for the interrupt copying operation. This message is continued until "a new value of R or less" is input (STP 22 and STP 23). When the "new value of R or less" is input and "R≧N2" is satisfied, the control flow is returned to STP 17 and the copying and sorting operation for the second document D2 is started. That is, the above-described interrupt copying process is carried out.

When the copying and sorting operation for the second document D2 has been completed, the interrupt copying mode of the apparatus body 2 is released (STP 2). In STP 17, the data relating to the first document D1 is fetched from the buffer memory 86 and the suspended copying and sorting operation for the first document D1 is resumed (STP 4). Specifically, the sorting unit 218 of the sorter 200 is vertically moved to stock the sheet P fed from the sheet guide 210 to a desired receiver, and the above-stated all copying and sorting operation for the first document D1 is carried out and completed. If a predetermined time (e.g. 60 sec.) has passed with no second document D2 placed on the second document tray 110*a*, despite the depression of the interrupt key 18*g*, the interrupt copying mode is automatically released and the suspended copying and sorting operation for the first document D1 is resumed. Besides, if a predetermined time (e.g. 60 sec.) has passed with no "new value" input, in the state wherein the interrupt copying operation is prohibited (STP 24), the interrupt copying mode is automatically released (STP 2). Simultaneously, the data relating to the document D1 is fetched and the suspended copying and sorting operation for the first document D1 is resumed (STP 4 to STP 1).

In the image forming apparatus 100 of this invention, at the time when all copying and sorting operations relating to the first document D1 have been completed, and where the copying operation for a new document D3 is set before removing the copied sheets P from the receivers 204*a* to 204*t* of the sorters 200 and 300, the interrupt sort mode (STP 13 to STP 24) are retained. That is, even if (sorted) copied sheets P remain in any of the receivers 204*a* to 204*t* of the sorters 200 and 300 during a predetermined time period (e.g. 30 sec.), it is possible, by using the other receivers, to sort and produce two or more copies of two or more documents. Specifically, the interrupt sort mode is held for a desired time period (e.g. 30 sec.) by means of the timer 88 (STP 31). When a third (new) document D3 is placed on the second document tray 110*a* (STP 32), an operation substantially identical to the interrupt sort mode (STP 13 to STP 24) is repeated.

For example, message "input the desired number of copies and the operation mode" is displayed on the LCD 18*e* (STP 33, an example of displayed message on LCD 18*e* is omitted). Responding to the displayed image, the number key 18*b* on the control panel 18 is depressed to input the desired number of copies. Simultaneously, the sort key 18*j* is turned on, and the CPU 90 determines whether the interrupt copying operation (set in STP 1) prevents the currently performed first copying operation. Suppose that N1 is the desired number of copies of document D1, which is now being copied (i.e. the number of used receivers in the sorters); N3 is the desired number of copies of the third document D3 which is to be copied; M1 is the number of receivers in the first sorter 200; M2 is the number of receivers in the second sorter 300; (M1+M2) is the limit number of copies to be stocked; and R is the number of receivers (i.e. non-used receivers) which can be used for the copying operation of the second document D2. In this case, the following equation is calculated (STP 34):

$$R=(M1+M2)-N1$$

Subsequently, it is determined whether the following relation is satisfied (STP 35):

$$R \geqq N3.$$

If the number of copies (N3) is less than the number of receivers (R), the interrupt sort mode is set (STP 36). At this time, the number of already copies of second documents D2 and the copying conditions (e.g. magnification) are set (STP 37). The print key 18*a* is depressed to start the copying and sorting operation relating to the third document D3.

Thereafter, the document D3 is fed to the document table 12, and the desired number of copies are obtained. The obtained copies are successively fed to the sorter 300 (STP 38). It is determined whether all copying operations relating to the new document D3 have been completed.

On the other hand, if the number of copies (N3) to be obtained by the interrupt copying operation is greater than the number of non-used receivers (R), the interrupt sorting operation is prevented (STP 41).

When the interrupt sorting operation is prohibited, for example, message "Are paper sheets removed, or has a value of R or less been input?" is displayed on the LCD 18*e* (STP 42). When the new value of R or less is input or the copied sheets P received in the sorters 200 and 300 are removed, and the condition, $R \geqq N3$, is met, the control flow is returned to STP 37. Thus, the copying and sorting operation relating to the third document D3 is started. That is, the interrupt sort process, as described above, is executed. In STP 42, if the new value of R or less is not input and the copied sheets P stocked in the sorters 200 and 300 are not removed, the interrupt sort mode is automatically released (STP 44) after the passing of a predetermined time period (e.g. 60 sec.)

Figure 8:
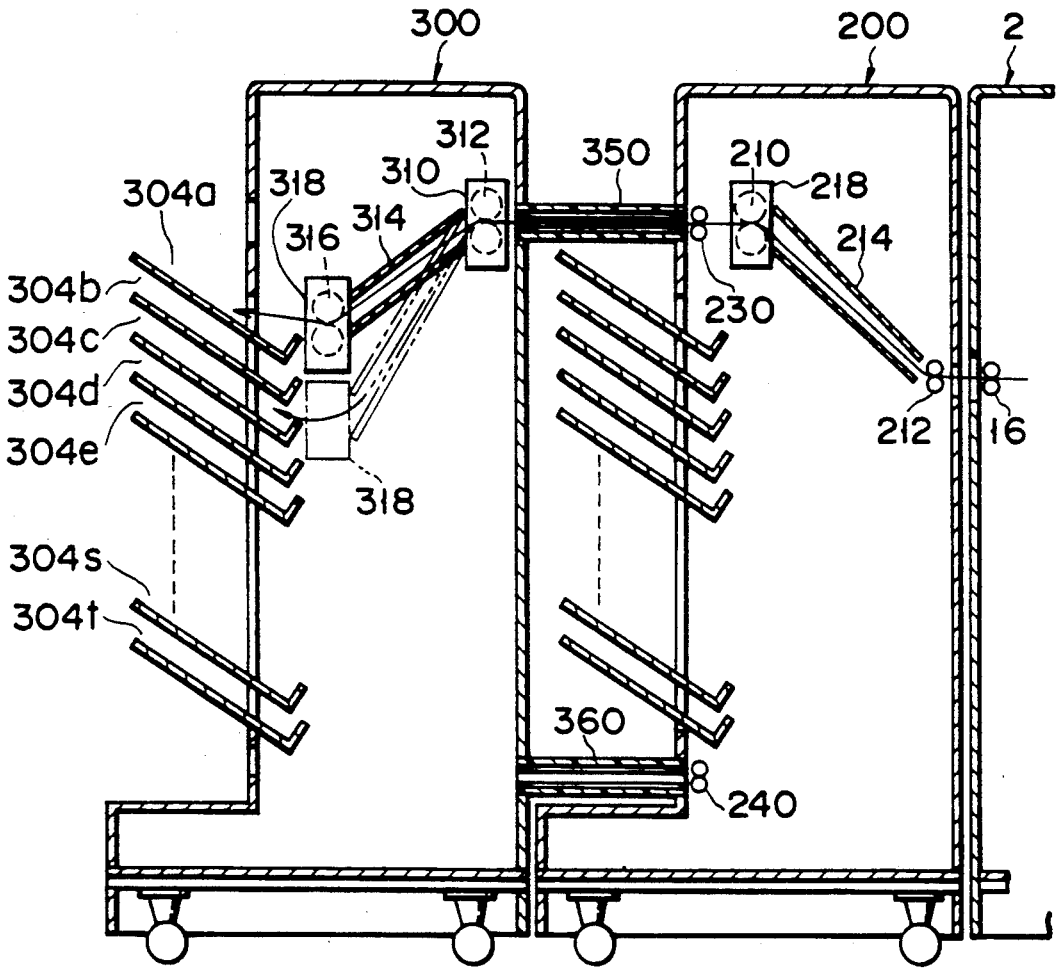
FIG. 8 illustrates the operation of the copying machine, on the basis of the flowcharts shown in FIGS. 7A to 7D.

FIG. 8 shows an example of the operation of the copying machine in the interrupt copying mode. If the desired number of copies (N2) of the second document D2 is 10, the first sheet P1 on which the image of document D2 has been copied is fed to the sheet guide 210 of the sorter 200 via the exit roller 16 in the apparatus body 2. The sheet P1 is supplied to the upper path 350 of the second sorter 300 via the sheet guide 210 (transporting rollers 212, inlet path 214 and roller 216), sorting unit 218 and first relay rollers 230. The sheet P1 is then fed from the upper path 350 to the second sorter 300 and is stocked in the first receiver 304*a* formed on the bin 302*a* via the sheet guide 310 (transporting rollers 312, inlet path 314 and rollers 316) and sorting unit 318. Subsequently, the next copied sheet P1', P1''. . . , are successively stocked in the receivers 304*b*, 304*c* . . . , 304*j*. Similarly, the next and following second documents D2 are successively conveyed onto the document table 12, and the obtained copied sheets P2, P2', P2''. . . , P3, P3', P''. . . , are successively discharged onto the receivers 304*a*, 304*b*, 304*c* . . . . In this embodiment, the copied sheets P relating to the first document D1 have already been stocked in the lower receivers 304*t* to 304*p*; thus, the copied sheets P1, P2, P3 . . . , obtained by the interrupt copying operation (i.e. copied sheets relating to the second document D2) are stocked successively from the uppermost receiver 304*a* towards the lowermost receiver 304*t*. The document D2, the copying operation for which has been completed, is discharged to the stacker 110*e* by the forward rotation of the conveyor belt 10*c* of the RADF 10.

As has been described above, according to the present invention, while at least two first documents are being copied, an interrupt copying operation (including a sorting operation) for at least two second documents can be carried out. More specifically, the image forming apparatus of this invention has a sorter which includes a first document tray on which first documents are placed, a second document tray on which second documents are placed, and two paths which can be switched. When an interrupt copying mode is selected, copies relating to the second documents can be sorted through a path which is different from the path employed for copies relating to the first documents. Even if a great number of copies must be produced and a plurality of copies must be obtained from a plurality of original documents, the wait time can be reduced and the efficiency of the copying operation of the image forming apparatus can be enhanced. Mixture of copies relating to two different original documents can be prevented, and the original documents can surely be separated. Therefore, complexity of copying operations can be relaxed.

Additional advantages and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims and their equivalents.

What is claimed is:

1. An image forming apparatus comprising:

means for forming an image of a first document on first image bearing materials or of a second document on second image bearing materials in a predetermined image forming operation corresponding to an image of a document;

means for interrupting a first image forming operation of the image forming means and setting the image forming means to a second image forming operation differing from the first image forming operation, while the image forming means is set in the first image forming operation;

a plurality of receivers for receiving the first and the second image bearing materials having the image formed by the image forming means; and means for sorting the first image bearing materials in at least two predetermined receivers, and sorting the second image bearing materials to at least two receivers other than said predetermined receivers, wherein said forming means further includes a first document receiver on which a first document is placed, and a second document receiver having detection means for detecting the fact that the second document has been placed and wherein said forming means suspends said first image forming operation and starts the second image forming operation for the second document, when the fact that the second document has been placed on the second document receiver while the first image forming operation for the first document placed on the first document receiver is being carried out, and said forming means enables said sorting means to sort and stack the obtained second image bearing materials relating to the second document into the receivers, through a passage different from the passage for the first image bearing materials relating to the first document and wherein said forming means prohibits the second copying operating in the case where the second copying operation mode is set while the first copying operation is being carried out, and the following formulae are not satisfied:

$$R=(M1+M2)-N1, \text{ and } R \geqq N2$$

where N2 is the number of copies set by the second copying operation mode;

N1 is the number of the receivers of the conveying means which have already been used for the first copying operation;

M1+M2 is the total number of the receivers of the conveying means; and

R is the number of the receivers of the conveying means which can be used for the second copying operation.

2. An image forming apparatus comprising:

means for forming an image of a first document on first image bearing materials or of a second document on second image bearing materials in a predetermined image forming operation corresponding to an image of a document;

means for interrupting a first image forming operation of the image forming means and setting the image forming means to a second image forming operation differing from the first image forming operation, while the image forming means is set in the first image forming operation;

a plurality of receivers for receiving the first and the second image bearing materials having the image formed by the image forming means; and means for sorting the first image bearing materials in at least two predetermined receivers, and sorting the second image bearing materials to at least tow receivers other than said predetermined receivers, wherein said sorting means sorts the materials having the image of the second document in an order reverse to the order in which the materials having the image of the first document are sorted.

3. An image forming apparatus comprising:

means for forming an image of a first document on first image bearing materials or of a second document on second image bearing materials in a predetermined image forming operation corresponding to an image of a document;

means for interrupting a first image forming means and setting the image forming means to a second image forming operation differing from the first image forming operation, while the image forming means is set in the first image forming operation;

a plurality of receivers for receiving the first and the second image bearing materials having the image formed by the image forming means; and means for sorting the first image bearing materials in at least two predetermined receivers, and sorting the second image bearing materials to at least two receivers other than said predetermined receivers, wherein said forming means has a time counting section for counting time when the image forming operation for the first document has been substantially completed, and for feeding, when the image forming operation relating to the second document is set by the interrupting means during a predetermined time period, the second image bearing materials, on which the images of the second document have been formed, to the receivers other than the receivers in which the first image bearing materials on which the images of the first original document have been formed have already been sorted and stacked.

4. An image forming apparatus comprising:

means for forming an image of a document placed on an image reading region;

a plurality of receivers for receiving image bearing materials on which the image has been formed by said forming means;

first convey means for conveying a first document placed at a first position to the image reading region;

second convey means for conveying a second document placed at a second position different from the first position to the image reading region; and means for sorting the image bearing materials such that in a case where a request for a second copying operation is made immediately after a first copying operation has completed and where the image bearing materials having an image of said first document are received in said receivers, the image bearing materials having the image of said second document are conveyed to the receivers other than the receivers which have received said image bearing materials having the image of said first document, wherein said forming means prohibits the second copying operating in the case where the second copying operation mode is set while the first copying operation is being carried out, and the following formulae are not satisfied:

$$R=(M1+M2)-N1, \text{ and } R \geqq N2$$

where N2 is the number of copies set by the second copying operation mode;

N1 is the number of the receivers of the conveying means which have already been used for the first copying operation;

M1+M2 is the total number of the receivers of the conveying means; and

R is the number of the receivers of the conveying means which can be used for the second copying operation.

5. An image forming apparatus comprising:

holding means, being optically transparent, for holding an original document placed thereon;

transmitting means for optically reading information on the original document placed on the holding means and for transmitting the read information to a photoconducting member;

means, including a tray on which an original document is placed, for conveying the original document placed on the tray to the holding means, and for further conveying the original document from the holding means to a stocker;

means for visualizing the information optically read from the original document and transmitted to the photoconducting member;

means for feeding an image-transfer medium to the transmitting means;

means for transferring the visualized information from the visualizing means to the image-transfer medium;

means for fixing the transferred information to the image-transfer medium;

means for grouping/stacking a plurality of image-transfer media, to which visualized information is fixed, said grouping/stacking means including a first storage section with a plurality of receivers and a second storage section with a plurality of receivers, said first and second storage sections being connected to each other by means of upper and lower sheet paths; and control means for controlling the image-transfer media supplied to the grouping/stacking means, wherein, in a case where the number of image-transfer media is larger than the number of receivers of the first storage section and is smaller than the total number of receivers of the first and second storage sections, the image-transfer media are first supplied into the receivers of the first storage section, and, after the receivers of the first storage section become full, are supplied into the receivers of the second storage section by way of the lower sheet path, and in a case where the receivers of the first and second storage sections include vacant receivers, the apparatus is set in a condition capable of starting an image-forming operation for another original document when an image-forming operation for the original document placed on the holding means has just been completed, and image-transfer media bearing images copied from said another original document are supplied to the vacant receivers by way of the upper sheet path.

6. The apparatus according to claim 5, wherein said forming means prohibits the second copying operating in the case where the second copying operation mode is set while the first copying operation is being carried out, and the following formulae are not satisfied:

$$R=(M1+M2)-N1, \text{ and } R \geqq N2$$

where N2 is the number of copies set by the second copying operation mode;

N1 is the number of the receivers of the conveying means which have already been used for the first copying operation;

M1+M2 is the total number of the receivers of the conveying means; and

R is the number of the receivers of the conveying means which can be used for the second copying operation.

* * * * *